US005086285A

United States Patent [19]

Arikawa et al.

[11] Patent Number: 5,086,285

[45] Date of Patent: Feb. 4, 1992

[54] TIME-CURRENT CHARACTERISTICS VARIABLE CHIP FUSE

[75] Inventors: Hiroo Arikawa, Tokyo; Yasutada Yuza, Kanagawa, both of Japan

[73] Assignee: SOC Corporation, Tokyo, Japan

[21] Appl. No.: 682,112

[22] Filed: Apr. 8, 1991

[30] Foreign Application Priority Data

May 10, 1990 [JP] Japan ..... 2-48196[U]

[51] Int. Cl.[5] ..... H01H 85/143; H01H 85/02

[52] U.S. Cl. ..... 337/231; 337/186; 337/201

[58] Field of Search ..... 337/231, 201, 186, 251, 337/252

[56] References Cited

U.S. PATENT DOCUMENTS 4,563,666 1/1986 Borzoni ..... 337/186

4,599,596 7/1986 Arikawa et al. ..... 337/201

FOREIGN PATENT DOCUMENTS 59-119546 8/1984 Japan .

62-172626 7/1987 Japan .

*Primary Examiner*—Harold Broome

*Attorney, Agent, or Firm*—Wenderoth, Lind & Ponack

[57] ABSTRACT

A chip fuse is disclosed which includes a rectangular parallelepiped box shaped main body with an opening on the upper side thereof, and a cover covering the opening. Two main terminals are disposed on opposite shorter side walls of the main body. A plurality of subsidiary terminals are located along inner faces of the opposite longer walls of the main body. A fusible element is extended, inside the main body, between one of the main terminals via a some or all of the plurality of subsidiary terminals and the other of the main terminals in a zigzag manner.

4 Claims, 3 Drawing Sheets

TIME-CURRENT CHARACTERISTICS VARIABLE CHIP FUSE

BACKGROUND OF THE INVENTION

1. Field of the Invention

The present invention relates to a subminiature chip fuse capable of being directly soldered to a printed circuit board for use.

2. Description of the Prior Art

In conventional chip fuses, a fusible element is stretched between metal terminal plates placed apart at a certain distance on a plane in such a manner that the end surfaces of the metal terminal plates oppose each other (for instance, refer to the official gazette of Japanese Utility Model Laid-Open No. 119546/1984) or wherein a pair of main electrodes are provided at ends of a flat chip board with a pair of auxiliary electrodes being provided at an intermediate portion between the main electrodes, and wires are connected between these main and auxiliary electrodes so as to be bonded thereto (for instance, refer to the official gazette of Japanese Patent Laid-Open No. 172626/1987).

In the former type of conventional chip fuse described above, only a narrow gap is feasible between the terminals in which a fusible element is extended due to the small size of a fuse body which is required in a chip fuse. As a result, in relation to the time-current characteristics thereof, an excessively fast fuse response tends to be exhibited, thereby causing a risk of the fusible element being fused by a rush current generated by switching during a normal operation.

In addition, the narrow gap necessitates the use of a short fusible element, which results in a fusible element having a low resistance. This requires a fusible element having a smaller diameter to be employed when attempting to produce a fuse with a lower current value. However, the extremely small diameter which is required for such a fusible element is impossible to manufacture. Even though a fusible element with such an extremely small diameter thereof may be manufactured, it would be extremely difficult for it to be assembled into a fuse.

In the latter type of conventional chip fuse, the surface of the wires is covered with a transparent resin that is curved in a lens fashion, and this transparent resin deprives the wires of Joule's heat. This makes the fusing performance thereof unstable. In addition, since there are provided only a pair of auxiliary electrodes, as in the case of the former chip fuse, an excessively fast fuse response is exhibited, and it is not possible to modify an such response time.

SUMMARY OF THE INVENTION

In view of the above problems that are inherent in the prior art chip fuses, an object of the present invention is to provide a chip fuse that may be easily produced, and which has variable time-current characteristics and exhibits a stable fusing performance.

This object is achieved by a time-current characteristics variable chip fuse comprising: a main body having a wall and a cavity defined by said wall in said main body; a pair of main terminals provided on said wall in such a manner that said pair of main terminals penetrate through said wall, and are opposed to eahc other, said pair of main terminals having end portions for electrical connection to an external circuit at the outer side of said wall; a plurality subsidiary terminals being located in said cavity at each of both sides of a line extending from one of said pair of main terminals to the other of said pair of main terminals; and a fusible element having both end portions which are respectively secured and electrically connected to said pair of main terminals, said fusible element being provided in said cavity in such a manner that said fusible element is extended between one of said pair of main terminal via some or all of said plurality subsidiary terminals and the other of said pair of main terminals in a zigzag fashion so as to be secured to said some or all of said plurality subsidiary terminals.

In addition, said fusible element may comprise a section extending between said subsidiary terminals and/or a section extending between a said subsidiary terminal and said main terminal, the melting point, thickness and/or resistivity of said sections or portions of one of said sections being partially or wholly different from one another.

Thus, the actual length of the fusible element can be made significantly greater than the distance between the main terminals. In addition, the length of the fusible element is determined depending on the number of subsidiary terminals used, and the time-current characteristics thereof is designed to vary depending on the length of the fusible element so determined. As a result of this, the time-current characterstics of the fusible elemtn can be designed in accordance with required circuit protection characteristics. Furthermore, it is possible to improve the time-current characteristics and to obtain a smaller rated current value by extending the fusible element in the space formed inside the main body.

These and other objects and advantages will become clear by reading the following description of the invention with reference to the accommpanying drawing.

DETAILED DESCRIPTION OF THE PREFERRED EMBODIMENTS

Figure 1:
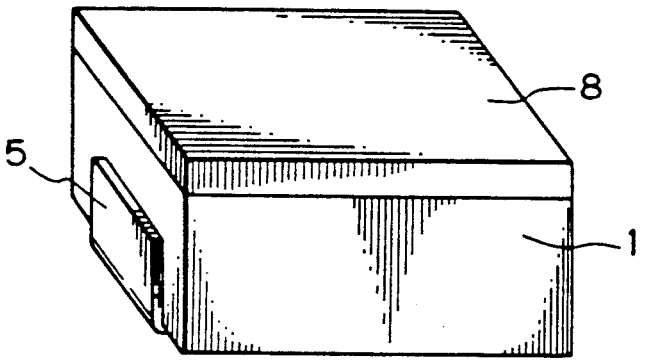
FIG. 1 is a perspective view of a chip fuse according to the present invention.

Referring to the drawings, the present invention will be described. FIG. 1 is a drawing showing the appearance of a chip fuse according to the present invention that has an extremely small main body which is 2.6 mm wide, 5 mm long and 2 mm high.

Figure 2:
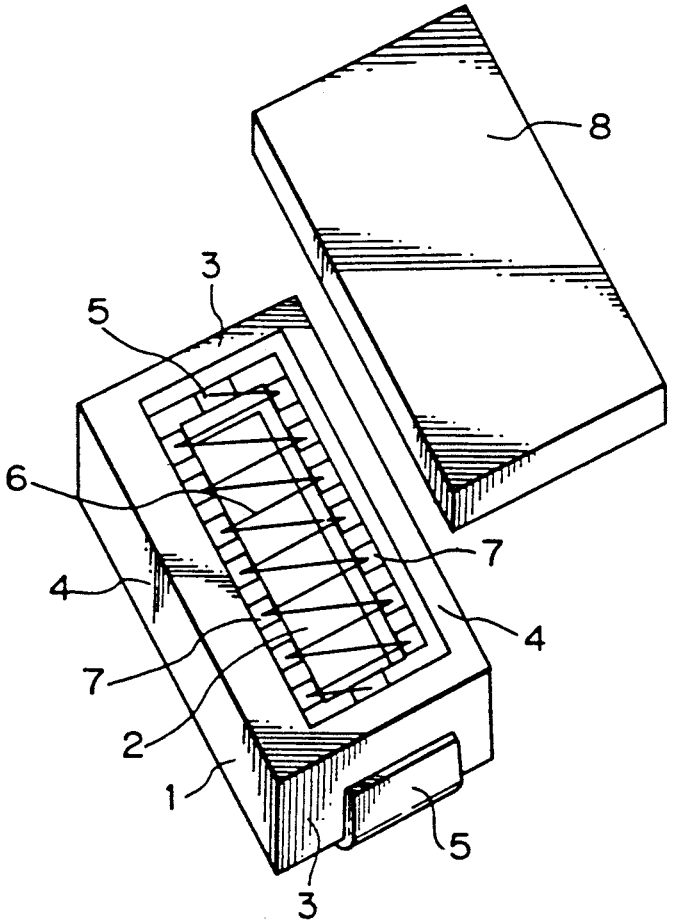
FIG. 2 is a perspective view showing the inside of a main body with a cover being removed for good visibility.
Figure 3:
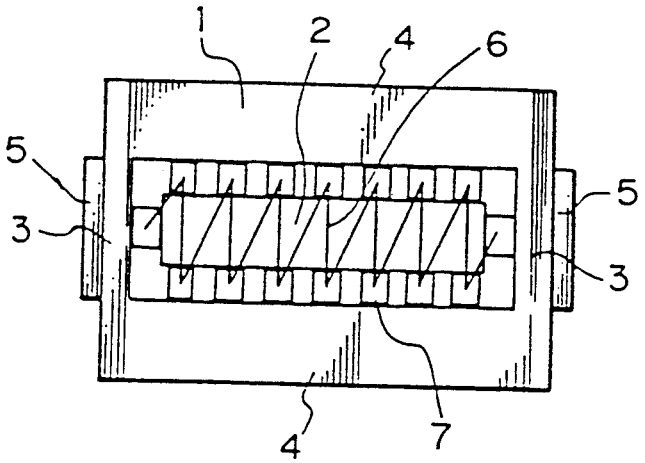
FIG. 3 is a plan view of the chip fuse without a cover illustrated in FIG. 2.
Figure 4:
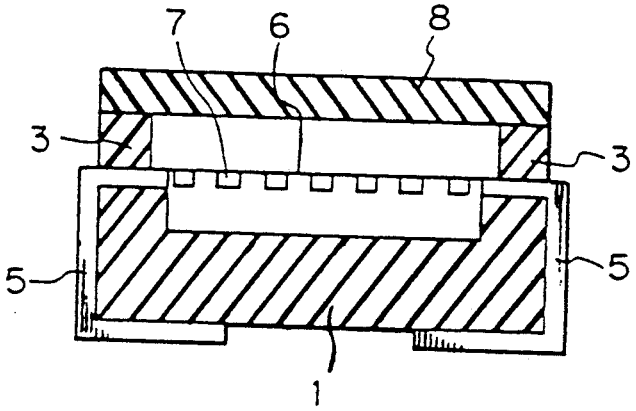
FIG. 4 is a cross-sectional view of the chip fuse illsutrated in FIG. 2.

FIG. 2 shows the inside of the main body of the present invention with a cover being removed for good visibility. FIGS. 3 and 4 are plan and cross-sectional views of the chip fuse without a cover illustrated in FIG. 2, respectively. Referring to FIGS. 2 to 4, the main body 1 is of a rectangular parallelepiped box shape and has an opening 2 on the upper side of the main body 1, opposite shorter side walls 3 and opposite longer side walls 4. A pair of main terminals 5 are disposed on the opposite shorter side walls 3 in such a manner that the terminals 5 penetrate through the opposite shorter side walls 3 so that both end portions of a fusible element 6 made of a fusible wire are respectively secured to both main terminals 5, 5 on the inner surface of the shorter side walls 3, while the main terminals 5 are directly soldered to an external circuit on the outer surfaces of the shorter side walls 3.

A plurality of subsidiary terminals 7 are fixed to the inner surfaces of the opposite longer side walls 4 of the main body 1 of a rectangular parallelepiped box shape when the body 1 is formed by a molding process. The plurality of subsidiary terminals 7 are disposed on the inner surface of the longer side walls 4 at equal intervals. These subsidiary terminals 7 serve as junction terminals when the fusible element 6 is extended between the pair of main terminals 5, 5. Thus, the fusible element 6 is extended from one of the pair of terminals 5 via the plurality of subsidiary terminals 7 to the other of the pair of terminals 5 in a zigzag fashion so as to be secured to the main terminals 5 and the plurality of subsidiary terminals 7. After the fusible element 6 has been extended between the main terminals 5 and secured thereto in this manner, an opening 2 of the box-shaped main body 1, which is the top side thereof, is hermetically sealed with a cover 8 and a chip fuse is thus completed.

In a case where the fusible element 6 is extended between the main terminals 5 in a zigzag fashion by making use of the subsidiary terminals 7, although the distance between the main terminals 5 is so short that they are disposed 5 mm apart from each other in order to meet the requirement for miniaturization of a chip fuse main body, the actual length of the fusible element is made equal to or greater than 20 mm, and thus, it is possible to obtain a fusible element length that is four or more times greater than that of a conventional chip fuse. As a result of this, the diameter of the fuse wire of the present invention may be increased by a factor of two or more when compared with that of a fuse wire used with the prior art chip fuse, and similarly, the time-lag characteristics of the chip fuse of the present invention can also be improved by a factor of two or more when compared with that of the prior art chip fuse.

Figure 5:
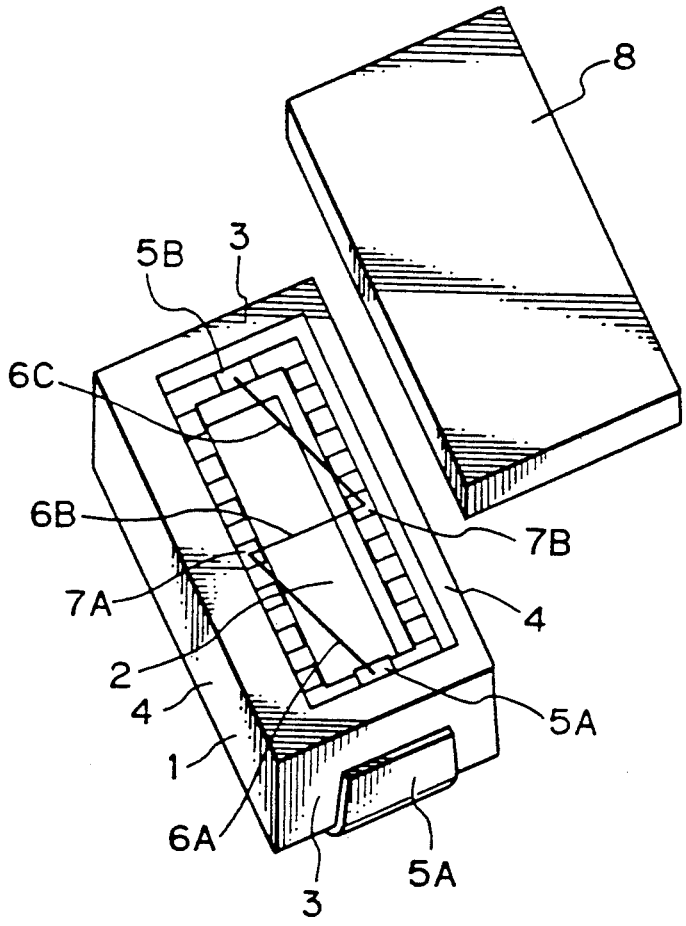
FIG. 5 is a perspective view of another embodiment of the present invention.

FIg. 5 shows another embdiment of the present invention in which the fusible element 6 is caused to transit the subsidiary terminals 7 in a fashion different from that described above with the thickness thereof being varied at an intermediate portion along the length thereof. In other words, a thick fusible element 6A is extended between the main terminal 5A and one of the subsidiary terminals 7A at one of the longer side walls 4 of the main body 1 and in turn mechanically connected to both of the terminals 5A, 7A, a thin fusible element 6B is then extended between the subsidiary terminals 7A and the other of the subsidiary terminals 7B at the other of the longer side walls 4 of the main body 1, which is positioned opposite the subsidiary terminals 7A, and in turn mechanically connected to both the terminals 7A, 7B, and a fusible element 6C which is as thick as the fusible element 6A extended between the main terminal 5A and the subsidiary terminal 7A is extended between the subsidiary terminal 7B and the other main terminal 5B and in turn mechanically connected to both terminals 7B, 5B. Thus, in case where a super fast response as the time-current characteristics of a chip fuse, are required to protect a semiconductor device with the present invention, the distance between the subsidiary terminals can be reduced to 0.6 mm, which is extremely short, and also the thickness of a fusible element used therebetween can be varied thereby making it possible to obtain superior super quick acting characteristics.

On top of this, it is also possible to make a chip fuse function as high-performance fusing resistors by using a wire with high resistance at a portion along the length of a fusible element. Furthermore, such a portion along the length of a fusible element extended can be constructed by a fusible wire with a melting point which is different from the one of the remaining portion of the fusible element according to various applications.

With prior art fusing resistors, it takes 60 to 90 seconds before fusion is effected under a load of ten times greater than the rated power therefor, and with some of those fusing resistors, the temperature at the time of fusion increase to become excessively high and reaches 200° C., causing a major problem of putting a substrate and other peripheral components under stress. In contrast, however, with the fusing resistors according to the present invention, an abnormal current is cut off within a second even under a load four times greater than the rated power therefor, and the temparature at the time of fusion increases little. Thus, the present invention exhibits a superior performance in protecting a circuit.

With the chip fuse of the present invention constructed as described above, various types of time-current characteristics, from time-lag characteristics to super quick acting characteristics, may be obtained with a single main body configuration, and a function as a fusing resistors may also be added thereto. Furthermore, with the present invention, fusible elements with smaller rated current values may easily be manufactured.

The present invention has been described in detail with reference to certain preferred embodiments thereof, but it will be understood that various modifications can be effected within the spirit and scope of the invention.

What is claimed is:

1. A time-current characteristics variable chip fuse comprising:

a main body having a wall and a cavity defined by said wall in said main body;

a pair of main terminals provided on said wall in such a manner that said pair of main terminals penetrate through said wall, and are opposed to each other, said pair of main terminals having end portions for electrical connection to an external circuit at an outer side of said wall;

a plurality of subsidiary terminals located in said cavity to each side of a line extending from one of the main terminals of said pair to the other of the main terminals of said pair; and a fusible element having end portions which are respectively secured and electrically connected to said pair of main terminals, said fusible element being provided in said cavity, said fusible element extending between one of the main terminals of said pair via some or all of said plurality subsidiary terminals and the other of the main terminals of said pair in a zigzag fashion, and said fusible element being mechanically connected to said some or all of said plurality of subsidiary terminals.

2. A time-current characteristics variable chip fuse as claimed in claim 1, wherein said fusible element comprises a section extending between said subsidiary terminals and/or a section extending between one of said subsidiary terminals and a said main terminal, the melting point, thickness and/or resistivity of said sections or of portions of one of said sections being partially or wholly different from one another.

3. A time-current characteristics variable chip fuse comprising:

a main body of a rectangular parallelepiped box shape having an opening on the upper side of said main body and oppositely disposed longer side walls and oppositely disposed shorter side walls;

a pair of main terminals provided on said opposite shorter side walls in such a manner that said pair of terminals penetrate through said opposite shorter side walls, said pari of main terminals having end portions for electrical connection to an external circuit at an outer of said opposite shorter side walls;

a plurality of subsidiary terminals located along the inner faces of said opposite longer side walls; a fusible element having end portions which are respectively secured and electrically connected to said pair of main terminals, said fusible element extending between one of the main terminals of said pair via some or all of said plurality of subsidiary terminals and the other of the main terminals of said pair in a zigzag fashion, and said fusible element being mechanically connected to said some or all of said plurality of subsidiary terminals; and a cover overlaid on said opening of said main body so as to produce a hermetically sealed structure.

4. A time-current characteristics variable chip fuse as claimed in claim 3, wherein said fusible element comprises a section extending between said subsidiary terminals and/or a section extending between one of said subsidiary terminals and a said main terminal, the melting point, thickness and/or resistivity of said section or of portions of one of said sections being partially or wholly different from one another.

* * * * *